United States Patent [19]

Doty

[11] 4,333,541

[45] Jun. 8, 1982

[54] BUMPER MOUNTED SOIL SAMPLING DEVICE

[76] Inventor: John G. Doty, Box 202, Carlyle, Saskatchewan, Canada

[21] Appl. No.: 163,102

[22] Filed: Jun. 26, 1980

[30] Foreign Application Priority Data

Nov. 1, 1979 [CA] Canada ..... 338946

[51] Int. Cl.[3] ..... E21B 7/02; E21B 10/02

[52] U.S. Cl. ..... 175/162; 173/22; 175/20; 175/249

[58] Field of Search ..... 175/162, 19, 20, 58, 175/249, 84; 173/22, 28

[56] References Cited

U.S. PATENT DOCUMENTS

| | | | |
|---|---|---|---|
| 1,830,752 | 11/1931 | Cornett | 299/37 X |
| 2,516,182 | 7/1950 | Bury | 173/28 |
| 2,807,441 | 9/1957 | Sewell | 173/28 X |
| 3,224,512 | 12/1965 | Alexander | 175/20 X |
| 3,324,958 | 6/1967 | Clark | 175/84 |
| 4,166,508 | 9/1979 | Berg | 175/20 |

FOREIGN PATENT DOCUMENTS

| | | | |
|---|---|---|---|
| 1123735 | 8/1968 | United Kingdom | 175/20 |

*Primary Examiner*—Stephen J. Novosad
*Attorney, Agent, or Firm*—Stanley G. Ade

[57] ABSTRACT

The soil sampling assembly is designed to be detachably secured within the central recess provided in the moulded rear bumper of small pick-up type trucks and the like. A bracket supports a pair of spaced and parallel members and a cylinder support extends upwardly therefrom and is adjustable lengthwise relative to said members. The cylinder is pivotally supported in a trunnion at the top of the cylinder support and the piston rod is pivotally connected to a soil probe tube extending downwardly from the cylinder. The device is easily actuated from a simple hydraulic system either driven by the truck motor or by a separate source of power in the truck and is easily attached and detached from the truck when required.

11 Claims, 8 Drawing Figures

BUMPER MOUNTED SOIL SAMPLING DEVICE

BACKGROUND OF THE INVENTION

This invention relates to new and useful improvements in soil sampling devices.

Such devices are usually relatively heavy and are mounted upon self-contained equipment which can only be used for that purpose. Examples include U.S. Pat. Nos. 3,872,935—3,149,682—3,273,930—3,696,873—3,057,415—1,830,752—3,324,958 and 2,709,368.

These all relate to soil sampling devices of one form or another with the exception of U.S. Pat. No. 1,830,752 which teaches a method of mounting a similar device on the back of a truck.

U.S. Pat. Nos. 3,872,935 and 3,324,958 show a constricted distal end to prevent displacement of the core and U.S. Pat. No. 3,324,958 shows a method of mounting a device on the side of a car or truck.

It is desirable to provide a relatively simple soil sampling device which is readily attached and detached from a conventional pick-up type truck so that it can be driven onto the fields and soil samples can be taken readily and easily by means of a soil sampling tube driven by a piston and cylinder assembly which is preferably operated hydraulically and driven either from the truck motor or a small engine acting as a separate source of power within the truck and which, of course, may be transported readily within the truck body.

SUMMARY OF THE INVENTION

One of the particular advantages of the present device is the fact that all of the equipment required is readily carried within a pick-up truck, to the desired location whereupon the soil sampling device is easily attached to the rear bumper of the truck by means of a pair of nut and bolt assemblies or the like and any ancillary equipment can be carried within the truck body and operatively connected to the soil sampling device.

In accordance with the invention there is provided a soil sampling device for use with a truck or the like having a recess formed in the moulded rear bumper thereof; comprising in combination an hydraulic piston and cylinder assembly including a piston rod secured to and extending from the piston of said piston and cylinder assembly, frame means supporting the cylinder of said piston and cylinder assembly, a soil sampling tube detachably secured to the distal end of the piston rod of said piston and cylinder assembly and means for detachably mounting said sampling device within the recess of the moulded rear bumper of the associated truck.

Another advantage of the present invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
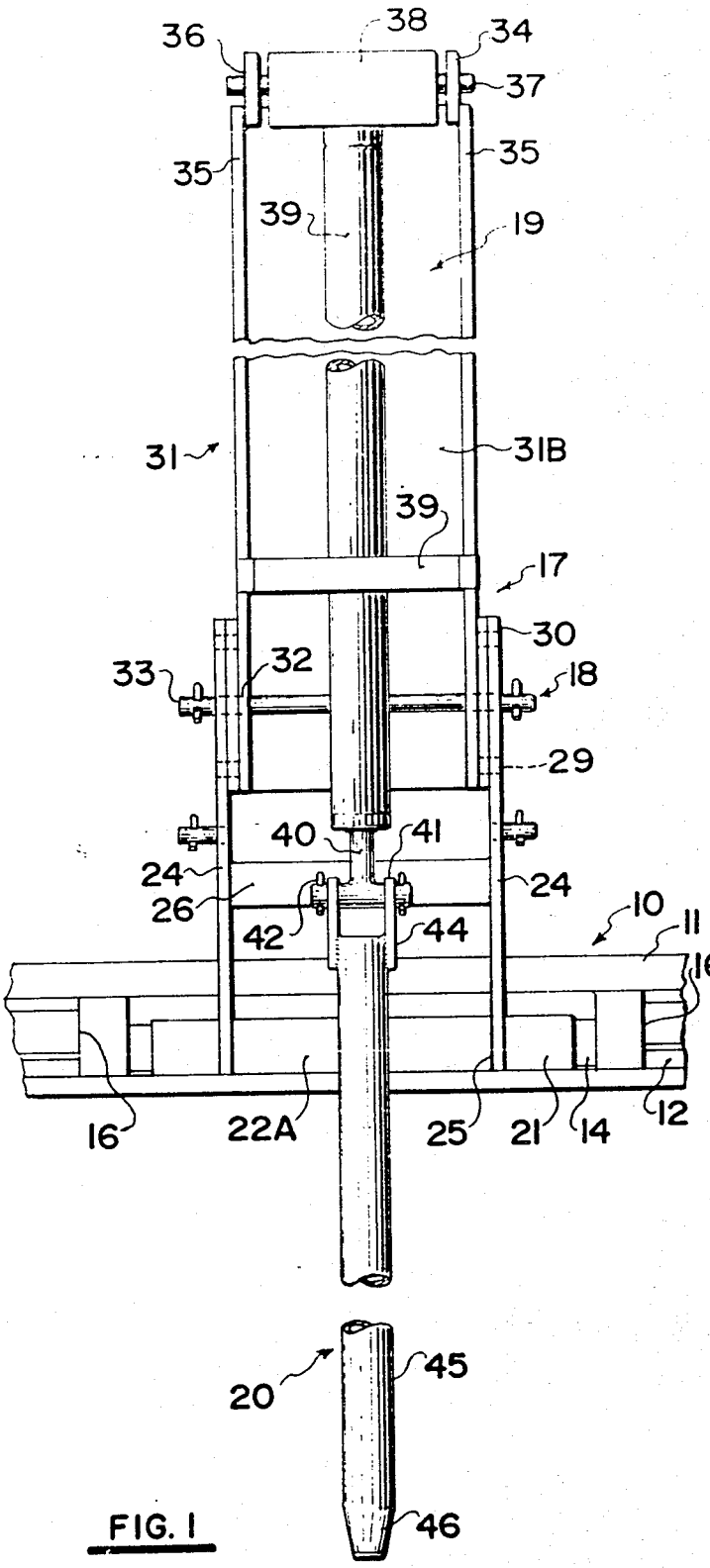
FIG. 1 is a rear elevation of part of the rear truck bumper showing the soil sampling assembly mounted thereto.

Proceeding therefore to describe the invention in detail, reference character 10 illustrates generally the rear end of a small pick-up truck which includes the pick-up truck floor 11 and a moulded rear bumper assembly 12. Such moulded rear bumper assemblies are secured to the rear frame 13 of the truck in the usual way and are provided with a centrally located recess 14 within which is often provided a hitch (not illustrated). This recess includes the transversely extending and vertical rear wall 15 and outwardly and rearwardly inclining vertical side walls 16.

The soil sampling device collectively designated 17, includes frame means generally designated 18 and a piston and cylinder assembly generally designated 19 together with a soil sampling tube assembly collectively designated 20.

In detail, the frame means includes means to detachably secure the entire assembly within the aforementioned recess 14 of the truck bumper 12, said means taking the form of a relatively short length of channel 21 with the spaced and parallel flanges 22, being situated transversely of the rear of the truck and parallel to the bumper and being seated within the recess 14 and detachably secured thereto by means of nut and bolt assemblies 22 extending through the base plate 23 thereof.

Figure 2:
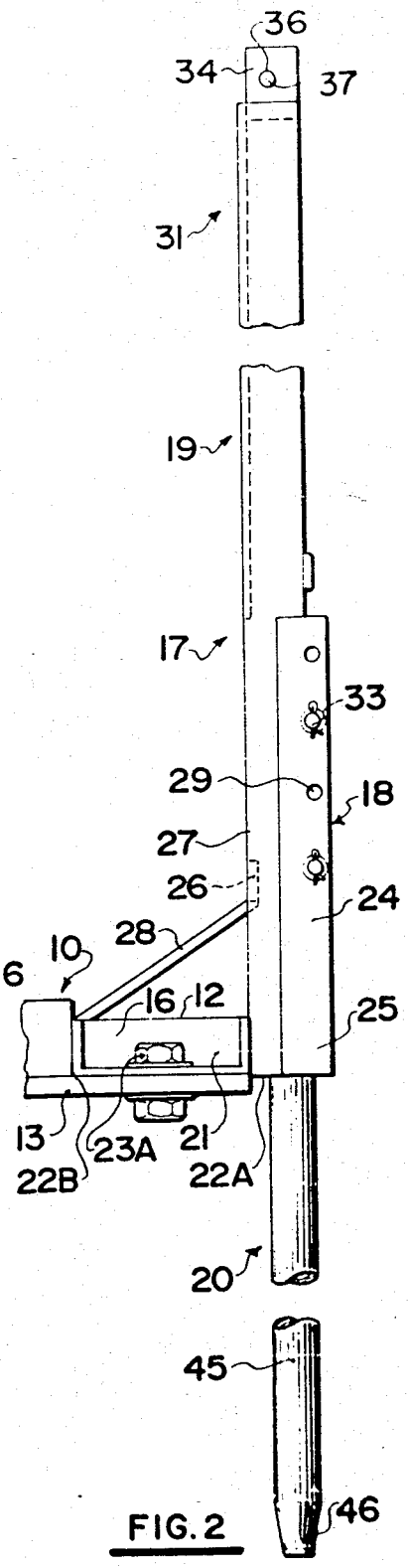
FIG. 2 is a side view of FIG. 1.

A pair of spaced and parallel side plates 24 are welded or otherwise secured by the lower ends 25 thereof, to the rearward side flange 22A of the channel 21 and these side plates extend upwardly from the channel as clearly shown in FIG. 2. A rear cross member 26 is secured across the rear edges 27 of the side plates 24 as by welding or the like and a brace 28 is secured centrally of the cross brace 26 and extends downwardly and forwardly to the front flange 22B of the channel 21, all of which is clearly indicated in FIG. 2.

A plurality of transverse apertures 29 are provided through the side plates 24 adjacent the upper ends 30 thereof and cross pins 33 may engage through these apertures as will hereinafter be described. A vertically situated channel collectively designated 31 is provided with a mounting plate 31A secured as by welding to each side flange 35 of the channel adjacent the lower ends thereof and extending slightly rearwardly of the web 31B. The portions of the mounting plates 31A extending rearwardly of the web 31B are also transversely apertured as at 32 so that the cross pins 33 may engage through selected pairs of apertures 29 and 32 thus giving limited adjustability to the overall positioning of the channel 31 relative to the side plate 24.

A pair of spaced and parallel bracket plates 34 are secured as by welding to adjacent the upper ends of the side flanges 35 of the channel 31 and these are apertured as indicated by reference character 36 to receive a pivot pin 37 which mounts a trunnion block 38 to which the upper end of a cylinder 39 is secured thus mounting the cylinder of the piston and cylinder assembly 19, at the upper end of the frame 17. The piston extends downwardly and is maintained freely within the channel by means of a front cross member 39A secured to the front edges of the side flanges of the channel 31 as clearly shown in FIGS. 1 and 2.

The piston rod 40 extending from the cylinder 39, is provided with a transverse bearing sleeve 41 upon the lower end thereof to receive a mounting pin 42 which also engages through apertures 43 formed in a pair of side plates 44 secured as by welding one upon each side of the upper end of the soil sampling tube 20. Details of this upper end of the soil sampling tube are shown in FIG. 6.

Figures 3, 4, 5, 6, 7, 8:
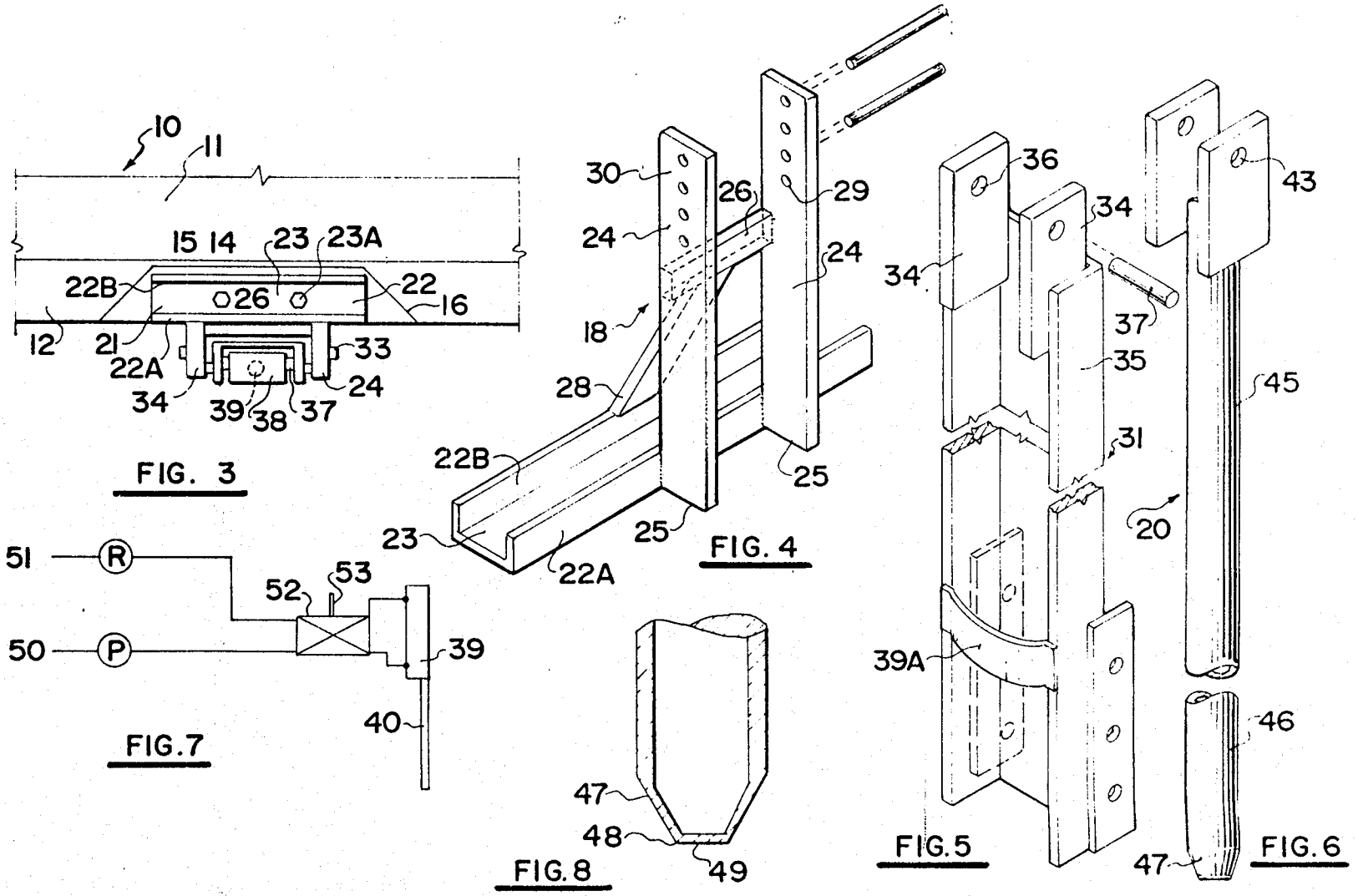
FIG. 3 is a top plan view of FIG. 1.
FIG. 4 is an isometric view of the lower mounting assembly per se.
FIG. 5 is an isometric view of the cylinder mounting assembly per se.
FIG. 6 is an isometric view of the soil probe assembly per se.
FIG. 7 is a simplified schematic showing an hydraulic circuit for the device.
FIG. 8 is an enlarged fragmentary cross sectional view of the lower end of the soil sampling tube.
Figure 1:
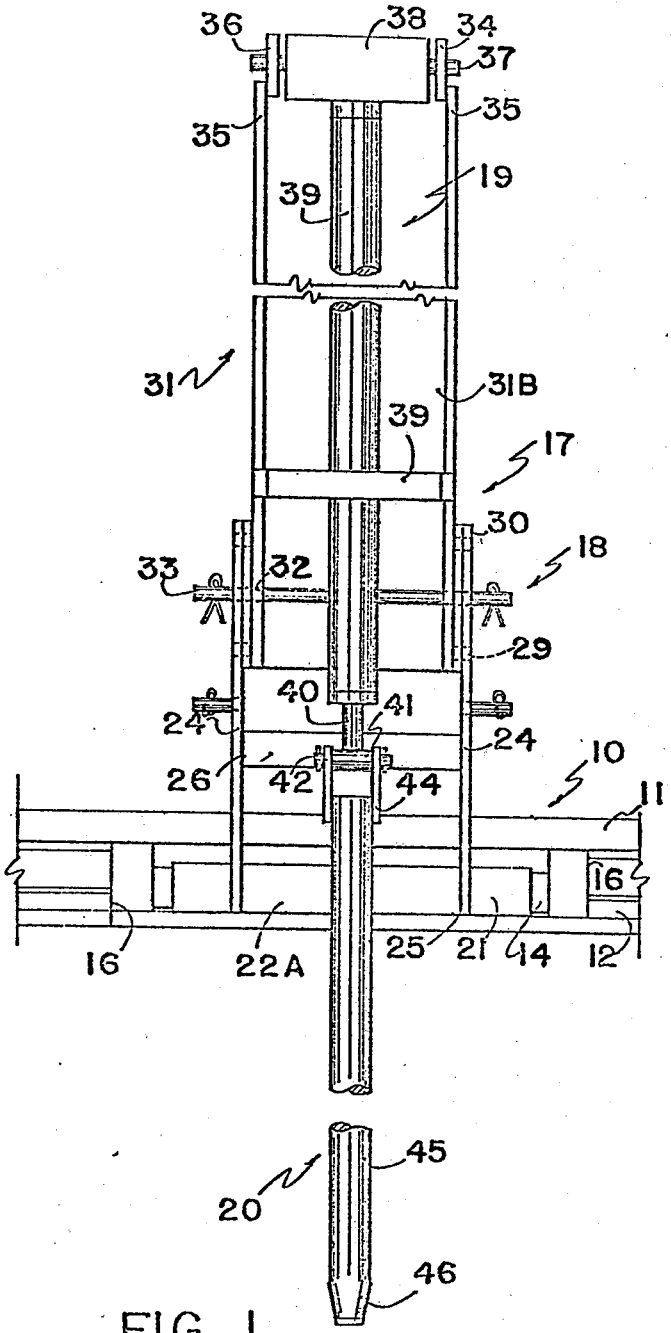
Figure 2:
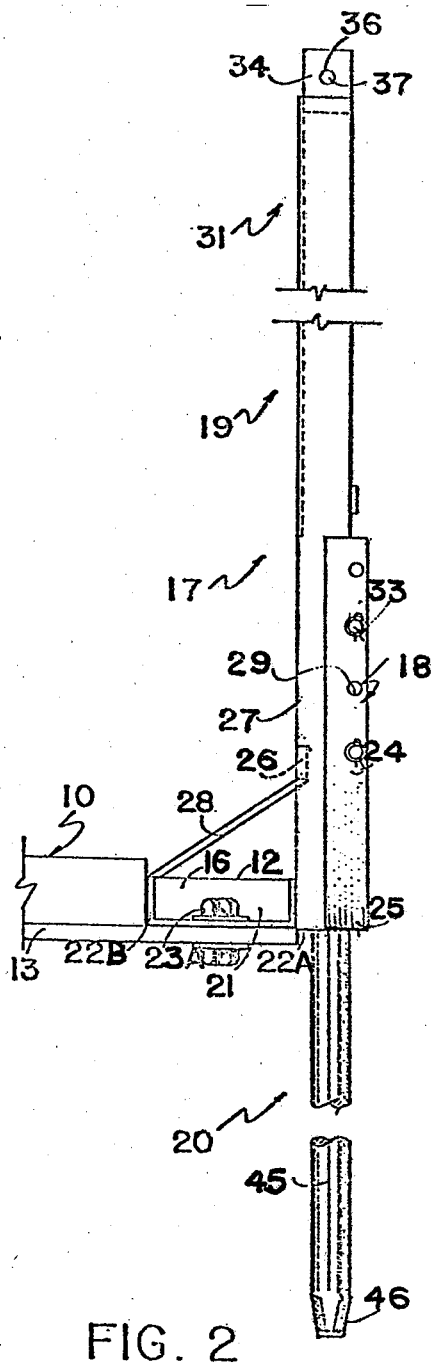
Figures 3, 4, 5, 6, 7, 8:
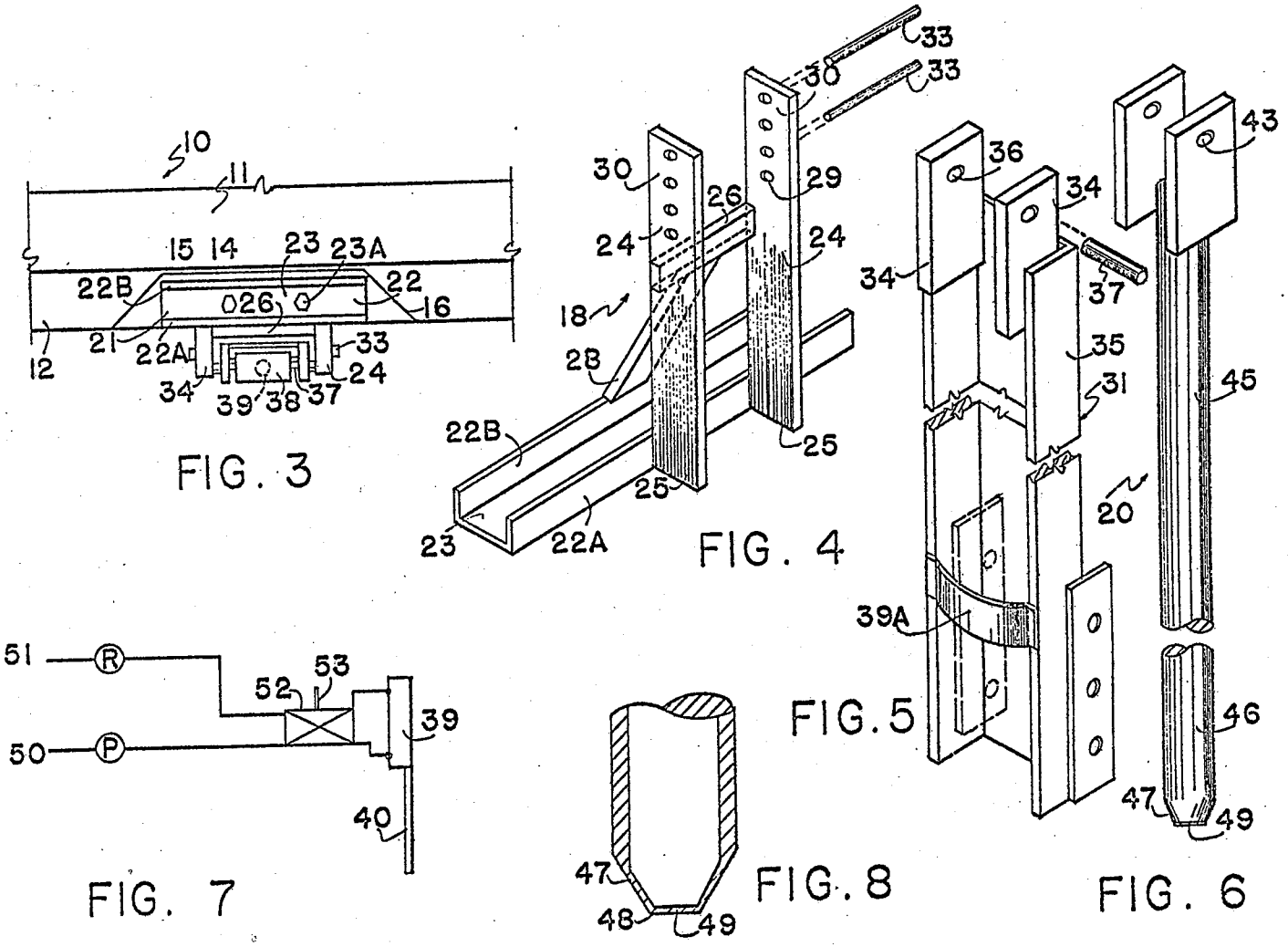

The soil sampling tube extends downwardly therefrom and comprises an open ended cylindrical tube specifically designated 45 having a soil engaging lower end 46 which tapers inwardly as indicated in FIG. 8 by reference character 47 and is edge sharpened as indicated by reference character 48.

This forms a restricted entry 49 which facilitates the entry of the tube within the soil as it is moved downwardly as will hereinafter be described, and also assists in retaining the plug of soil within the tube when the tube is withdrawn.

In operation, the device is detachably secured to the rear bumper recess as hereinbefore described and connected to any convenient hydraulic system either operated from the engine of the pick-up or from a separate source of power within the truck. FIG. 7 shows a simplified hydraulic circuit including a pump 50, a reservoir 51 and a two-way valve 52 operatively connected thereto and controlled by means of valve control 53. This routes fluid under pressure to either end of the cylinder 39 thus extending or retracting the piston rod 40 together with the soil sampling tube assembly 20.

The tube is driven downwardly into the soil thus engaging a sample thereof within the tube which is assisted in being retained by the restricted lower end 49 as hereinbefore described.

It will therefore be seen that a simple and easily operated and assembled soil sampling device is provided particularly suitable for use in rapid and easy soil sampling of farm lands and the like.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A soil sampling device for use with a truck or the like having a recess formed in the moulded rear bumper thereof; comprising in combination an hydraulic piston and cylinder assembly including a piston rod secured to and extending from the piston of said piston and cylinder assembly, frame means supporting the cylinder of said piston and cylinder assembly, a soil sampling tube detachably secured to the distal end of the piston rod of said piston and cylinder assembly and means for detachably mounting said sampling device within the recess of the moulded rear bumper of the associated truck, said soil sampling tube including an elongated open ended tube, a pair of attaching plates secured one upon each side of said tube adjacent the upper end thereof and extending upwardly therefrom, means detachably securing said pair of attaching plates to the distal end of the piston rod of said piston and cylinder assembly, the lower end of said soil sampling tube being inwardly tapered and edge sharpened to form a restricted intake end to said soil sampling tube to facilitate the penetration of same within the ground and to assist in retaining the soil sample therein.

2. The invention according to claim 1 in which said frame means includes a pair of spaced and parallel side plates secured to and extending upwardly from said means detachably mounting said sampling device within the recess, a cylinder mounting structure adjustably secured to adjacent the upper end of said side plates and trunnion means mounting said cylinder by the upper end thereof to adjacent the upper end of said cylinder mounting structure.

3. The invention according to claim 2 in which said means for detachably mounting said soil sampling device within the recess of the moulded rear bumper of the associated truck includes a transverse channel member detachably secured within the recess, said pair of spaced and parallel side plates being secured to and extending upwardly from said transverse channel member and brace means extending between said frame means and said transverse channel.

4. The invention according to claim 1 in which said means for detachably mounting said soil sampling device within the recess of the moulded rear bumper of the associated truck includes a transverse channel member detachably secured within the recess, said frame means supporting said piston and cylinder assembly being secured to and extending upwardly from said transverse channel member and brace means extending between said frame means and said transverse channel.

5. A soil sampling device for use with a truck or the like having a recess formed in the moulded rear bumper thereof; comprising in combination an hydraulic piston and cylinder assembly including a piston rod secured to and extending from the piston of said piston and cylinder assembly, frame means supporting the cylinder of said piston and cylinder assembly, a soil sampling tube detachably secured to the distal end of the piston rod of said piston and cylinder assembly and means for detachably mounting said sampling device within the recess of the moulded rear bumper of the associated truck, said means for detachably mounting said soil sampling device within the recess of the moulded rear bumper of the associated truck including a transverse channel member detachably secured within the recess, said frame means supporting said piston and cylinder assembly being secured to and extending upwardly from said transverse channel member and brace means extending between said frame means and said transverse channel.

6. The invention according to claim 5 in which said soil sampling tube includes an elongated open ended tube, a pair of attaching plates secured one upon each side of said tube adjacent the upper end thereof and extending upwardly therefrom, means detachably securing said pair of attaching plates to the distal end of the piston rod of said piston and cylinder assembly, the lower end of said soil sampling tube being inwardly tapered and edge sharpened to form a restricted intake end to said soil sampling tube to facilitate the penetration of same within the ground and to assist in retaining the soil sample therein.

7. The invention according to claim 6 in which said means for detachably mounting said soil sampling device within the recess of the moulded rear bumper of the associated truck includes a transverse channel member detachably secured within the recess, said pair of spaced and parallel side plates being secured to and extending upwardly from said transverse channel member and brace means extending between said frame means and said transverse channel.

8. The invention according to claims 2, 6 or 7 in which said cylinder mounting structure includes a vertically situated channel member including a pair of spaced and parallel side flanges and a web extending therebetween at the rear edges of the side flanges, a multi-apertured mounting plate secured to adjacent the lower ends of each of side flanges with the apertured portions being set rearwardly of said web, said side plates also being apertured and a pair of connecting pins selectively engaging apertures in said mounting plates and apertures in said side plates to vertically adjust the position of said channel member within limits, relative to said side plates.

9. The invention according to claim 5 in which said frame means includes a pair of spaced and parallel side plates secured to and extending upwardly from said means detachably mounting said sampling device within the recess, a cylinder mounting structure adjustably secured to adjacent the upper end of said side plates and trunnion means mounting said cylinder by the upper end thereof to adjacent the upper end of said cylinder mounting structure.

10. The invention according to claim 5 in which said soil sampling tube includes an elongated open ended tube, a pair of attaching plates secured one upon each side of said tube adjacent the upper end thereof and extending upwardly therefrom, means detachably securing said pair of attaching plates to the distal end of the piston rod of said piston and cylinder assembly, the lower end of said soil sampling tube being inwardly tapered and edge sharpened to form a restricted intake end to said soil sampling tube to facilitate the penetration of same within the ground and to assist in retaining the soil sample therein.

11. The invention according to claim 9 in which said soil sampling tube includes an elongated open ended tube, a pair of attaching plates secured one upon each side of said tube adjacent the upper end thereof and extending upwardly therefrom, means detachably securing said pair of attaching plates to the distal end of the piston rod of said piston and cylinder assembly, the lower end of said soil sampling tube being inwardly tapered and edge sharpened to form a restricted intake end of said soil sampling tube to facilitate the penetration of same within the ground and to assist in retaining the soil sample therein.

* * * * *